United States Patent [19]

Sanders

[11] Patent Number: 4,989,308

[45] Date of Patent: Feb. 5, 1991

[54] BIDIRECTIONAL ROOF SEAMING MACHINE

[75] Inventor: William J. Sanders, Kansas City, Kans.

[73] Assignee: Butler Manufacturing Company, Kansas City, Mo.

[21] Appl. No.: 209,331

[22] Filed: Jun. 20, 1988

[51] Int. Cl.[5] ..... B23P 11/00; B21D 39/02

[52] U.S. Cl. ..... 29/243.5; 72/210

[58] Field of Search ..... 29/243.5, 243.57, 243.58; 72/210, 211, 214; 310/68 A, 156

[56] References Cited

U.S. PATENT DOCUMENTS

| | | | |
|---|---|---|---|
| 2,764,705 | 9/1956 | Albertson et al. | 310/68 A |
| 3,609,845 | 10/1971 | Taylor | 29/243.5 |
| 3,875,642 | 4/1975 | Knudson | 29/243.5 |
| 4,027,611 | 6/1977 | Ward et al. | 29/243.5 |
| 4,348,603 | 9/1982 | Huber | 310/68 A |

*Primary Examiner*—E. Michael Combs

*Attorney, Agent, or Firm*—Shoemaker and Mattare, Ltd.

[57] ABSTRACT

A roof seaming machine has symmetrically arranged forming rolls and a reversible permanent magnet motor for operation of the machine in either a forward or reverse direction. Adjustable linkage connects the forming rolls with an articulated handle for moving the forming rolls relative to a drive wheel which propels the machine and which is adapted to be disposed on the opposite of a seam from the forming rolls. A reversible switch is connected to energize and deenergize the motor, and a directional switch safety guard is associated with the switch to limit its movement between an "off" position and either one of two "on" positions, depending upon the positioning of the guard.

5 Claims, 7 Drawing Sheets

BIDIRECTIONAL ROOF SEAMING MACHINE

FIELD OF THE INVENTION

This invention relates to tools for forming building components, and more particularly, to a machine for seaming roof panels.

PRIOR ART

In the building construction industry, and especially in the construction of commercial buildings, metal roof panels are frequently used. These metal panels are formed with flanges along opposite side edges which are nested within one another and then bent over with a flanging tool or seaming machine to make a leak proof seam. Numerous devices are known in the art for making such seams, ranging from hand tools to electrically or pneumatically operated machines.

Hand seaming is too labor intensive to be economically feasible for most projects, and the machines currently in use are generally relatively heavy and cumbersome to use. Moreover, some machines do not have any adjustment for different gauges of metal, and other machines must be partially disassembled to adjust or substitute parts for accommodating different gauges. Further, most machines will seam in only one direction and after forming a seam must be returned to the opposite end of a panel to begin forming another seam.

Conventional electrically operated machines use AC or AC/DC field wound motors. This limits their use to power cord extensions which do not exceed about 200 feet for 12 gage or greater electrical cable. Otherwise, the power loss is too great and high current loads are induced in the motor, shortening its life. In addition, reduced power to the motor reduces its torque as well as its speed. Conventional electric motor machines also "coast" when shut off, and seaming speed must be reduced or the motor must be "jogged" excessively to accurately position the machine when stopping. This reduces motor life and makes the machine more difficult and time-consuming to use.

Some prior art machines require an additional control apparatus for selecting seaming direction, which not only is cumbersome to handle and requires diversion of the operator's attention, but is an additional wiring apparatus to be maneuvered and maintained.

Many machines also require a substantial amount of hand seaming due to the relatively large "footprint" of the machine and the consequent inability to position the machine close to obstructions or walls. Some machines even span an entire panel width.

SUMMARY OF THE INVENTION

It is therefore an object of the present invention to provide a roof seaming machine which is lightweight and easy and economical to use.

Another object of the invention is to provide a roof seaming machine having a DC permanent magnet gear motor, enabling higher starting and lower speed running torques and resulting in a lighter weight and smaller size for a given power output.

A further object of the invention is to provide a machine for seaming roof panels, in which the forming rolls in the machine are symmetrically arranged for reversible operation of the machine.

Yet another object of the invention is to provide a roof seaming machine constructed so that it can form a seam close to an obstruction such as a wall or the like.

Another object of the invention is to provide a roof seaming machine having several preset adjustments for seaming roof panels of different gauge metals.

A still further object of the invention is to provide an electrically operated roof seaming machine in which the field winding in the motor is replaced with a permanent magnet, whereby the motor has self-braking characteristics enabling more accurate positioning of the machine.

Yet another object of the invention is to provide an electrically operated roof seaming machine in which a permanent magnet motor is used, enabling very long power cord extensions to be used without loss of torque.

An even further object of the invention is to provide an electrically operated roof seaming machine which is operable in both forward and reverse directions and in which a directional switch guard is associated with the power switch to prevent movement thereof from a forward to a reverse position while the machine is operating.

A further object of the invention is to provide an adjustable guard for a double-pole, double-throw switch that controls power to a reversible motor of an electrically operated apparatus, in which the guard permits movement of the switch only between a center "off" position and either one of its two "on" positions, depending upon the adjusted position of the guard, and is operative to shut off power to the motor if the guard is adjusted while the motor is being operated.

Another object of the invention is to provide a guard for the power switch of the electric motor of a reversible roof seaming machine, in which the guard provides a visual indication of the direction of operation of the machine as well as preventing movement of the switch into a reverse position.

A still further object of the invention is to provide a roof seaming machine in which the forming rolls are carried on a movable pressure bar attached to the machine through adjustable linkage and a slide mount, said pressure bar and forming rolls being moved into and out of operative position by an articulated handle which may be folded to an out-of-the-way position to enable the machine to be brought close to an obstacle, such as a wall or the like.

An even further object of the invention is to provide a roof seaming machine having a single forming roll movably supported in opposition to a single drive wheel, with leading and trailing idler rolls disposed fore and aft, respectively, of the forming roll for transferring a horizontal force through the crown of the seam to the drive wheel, for preforming the material of the seam prior to final shaping at the forming roll, and for holding the machine square.

The foregoing objects are attained in a machine having a permanent magnet motor mounted on a base plate and connected to rotate a drive wheel supported beneath the base plate. A slide mount has one part fixed on the base plate and another part slidably movable relative thereto. A pressure bar is carried by the movable part, whereby the pressure bar is laterally movable in guided relationship relative to the base plate. A main forming roll is carried by the pressure bar in opposed relation to the drive wheel, and leading and trailing idler rolls are carried by the pressure bar fore and aft, respectively, of the forming roll.

The forming roll and idler rolls are symmetrically arranged on the machine so that the machine may be operated in either a forward or reverse direction, and a multi-position switch is movable between a center "off" position and either of two opposite "on" positions to actuate the machine in either of two directions. A directional switch guard is associated with the power switch to permit movement of the switch to only one of its "on" positions and is operative to automatically move the switch to its "off" position if the guard is moved from one directional position to another position. For reverse operation of the machine, the guard is moved into a different position so that the switch can then be moved only into its other "on" position.

Adjustable, over-center type linkage is connected with the pressure bar for moving it and thus the forming roll relative to the base plate and drive wheel, and an articulated handle is connected between the base plate and the linkage for operating the linkage. The adjustable linkage includes a simple indexing attachment to the handle so that the machine may be quickly and easily adjusted to seam different gauge metals.

The machine is supported on resilient wheels made from an elastomeric, non marking material, and the drive wheel is also made from a resilient material such as urethane or the like, whereby the machine may be used for seaming panels of painted material without marring the finish of such panels.

BRIEF DESCRIPTION OF THE DRAWINGS

The foregoing objects of the invention, as well as other objects and advantages, will become apparent from the following detailed description and accompanying drawings, wherein like reference characters designate like parts throughout the several views, and wherein.

DETAILED DESCRIPTION OF THE PREFERRED EMBODIMENTS

Figure 5:
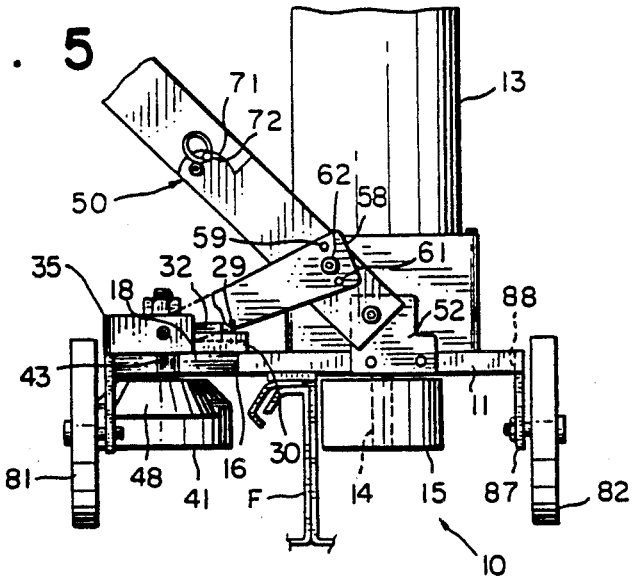
FIG. 5 is an enlarged, fragmentary view in end elevation of the machine of FIG. 1, showing the pressure bar and forming roll in their open position depicted in FIG. 4 for application to the flanges of a pair of abutting panels to be seamed.
Figure 6:
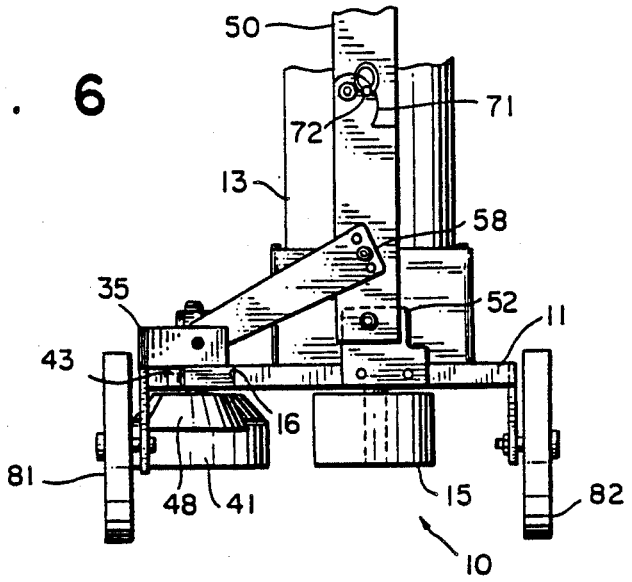
FIG. 6 is a view similar to FIG. 5, showing the pressure bar and forming roll in the intermediate position depicted in FIG. 3.

Referring more particularly to the drawings, a roof seaming machine in accordance with the invention is indicated generally at 10. The seaming machine comprises a base plate 11 of generally rectangular configuration having a central opening 12 therethrough. A permanent magnet motor 13 is supported on the base plate and has a drive shaft 14 projecting through the opening 12. A urethane drive wheel 15 is secured on the drive shaft beneath the base plate for engaging one side of the flange "F" (see FIG. 5) on a roof panel to propel the machine along the flange.

Figure 1:
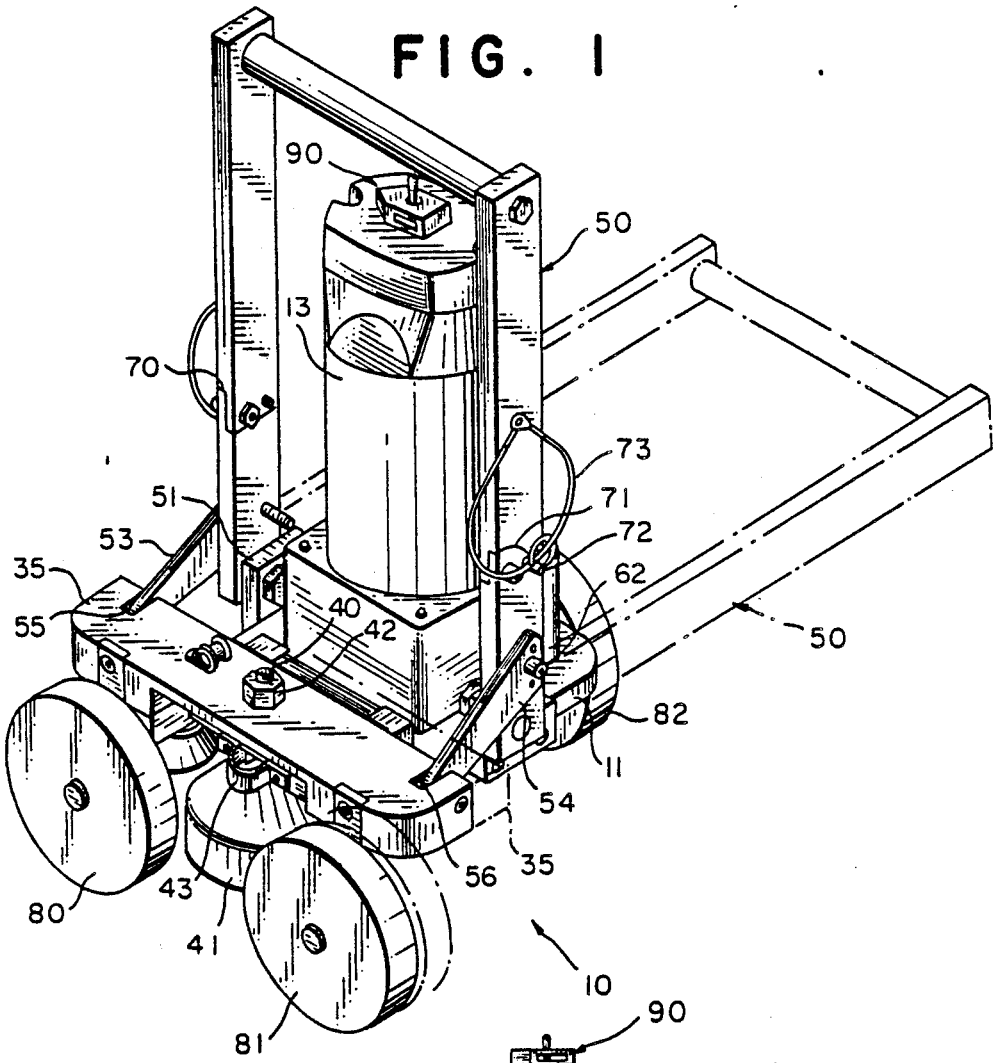
FIG. 1 is a top perspective view of the machine according to the invention.
Figure 2:
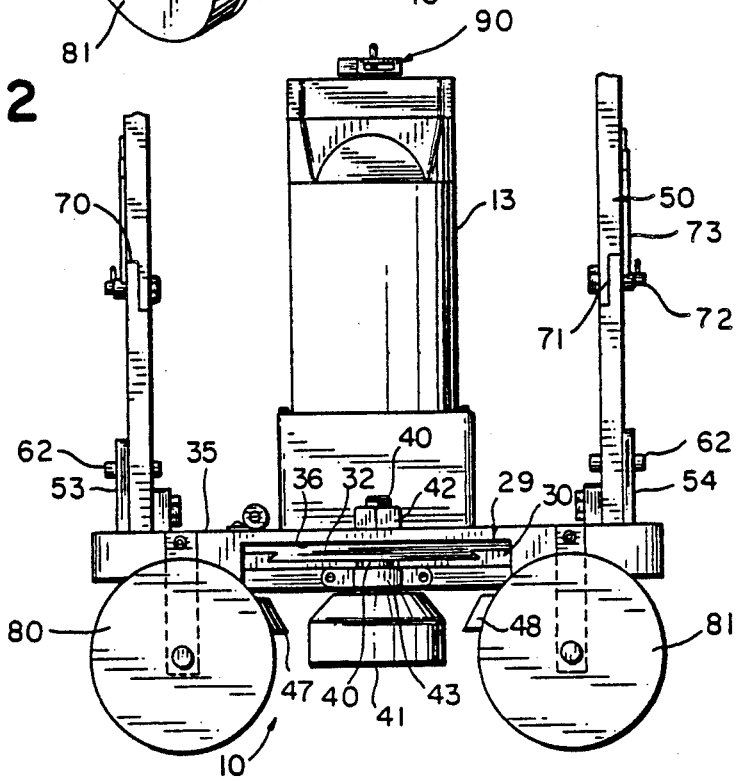
FIG. 2 is an enlarged fragmentary view in side elevation of the machine of FIG. 1.
Figure 3:
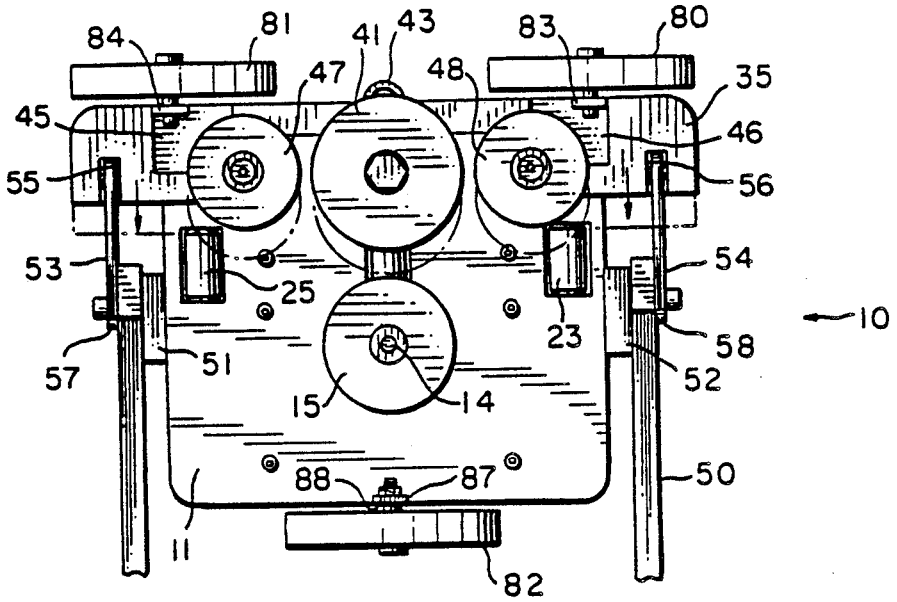
FIG. 3 is an enlarged, fragmentary bottom plan view of the machine of FIG. 1, showing the pressure bar and forming roll moved to an intermediate position.
Figure 4:
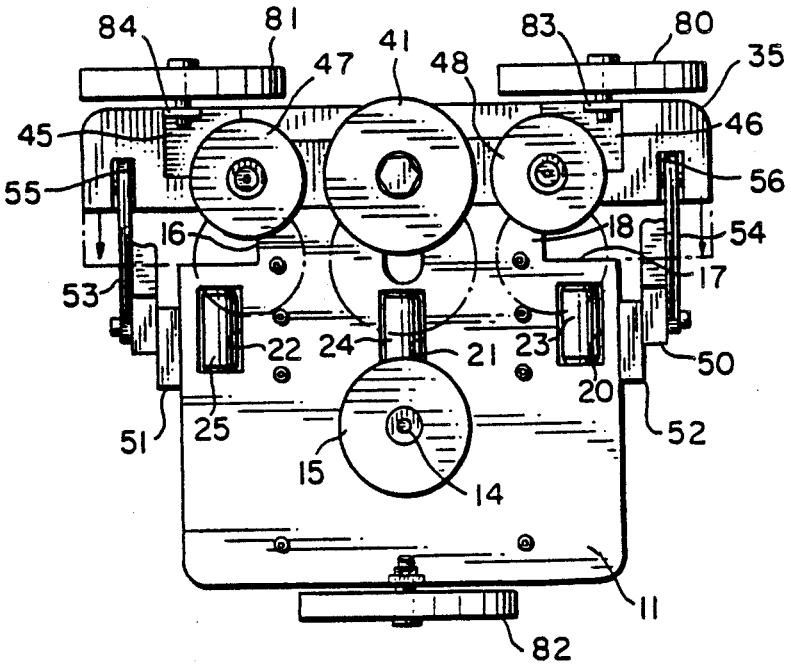
FIG. 4 is a view similar to FIG. 3, showing the pressure bar and forming roll moved to the open position.
Figure 7:
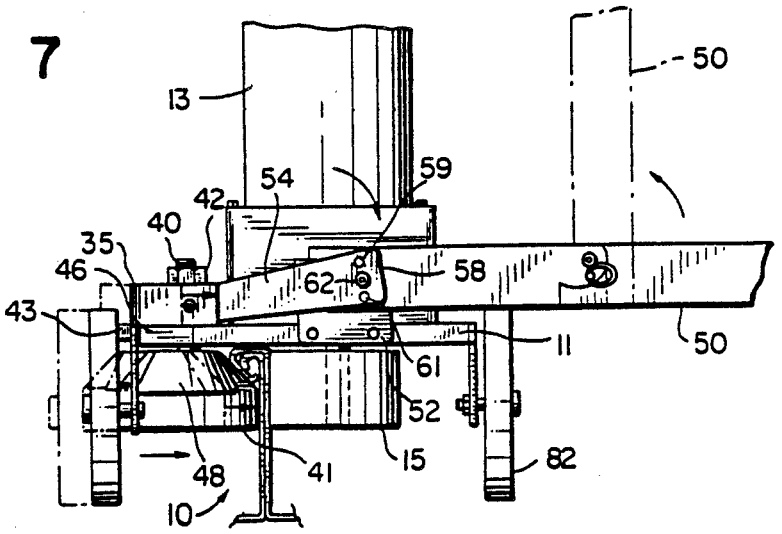
FIG. 7 is a view similar to FIG. 6, showing the pressure bar and forming roll moved to their closed position on a seam to be formed.
Figure 8:
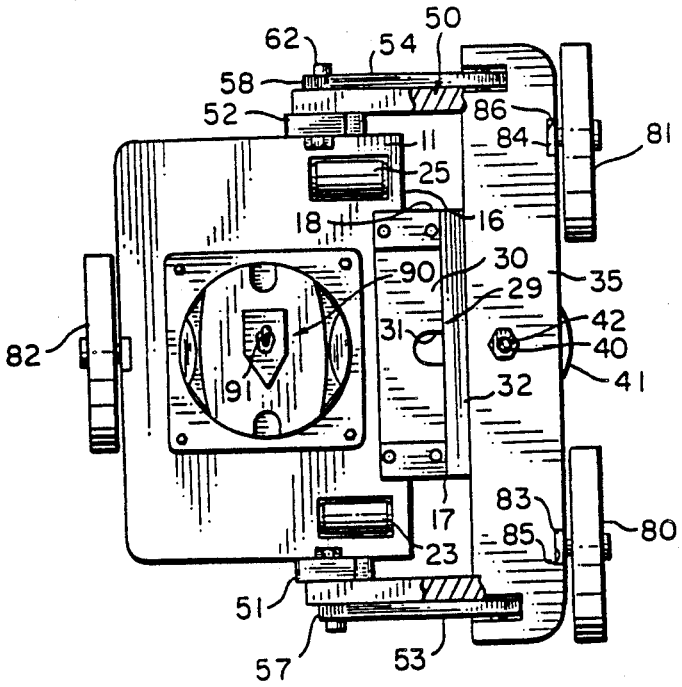
FIG. 8 is an enlarged fragmentary top plan view of the machine of FIG. 1, showing the pressure bar moved to its full open position.
Figure 9:
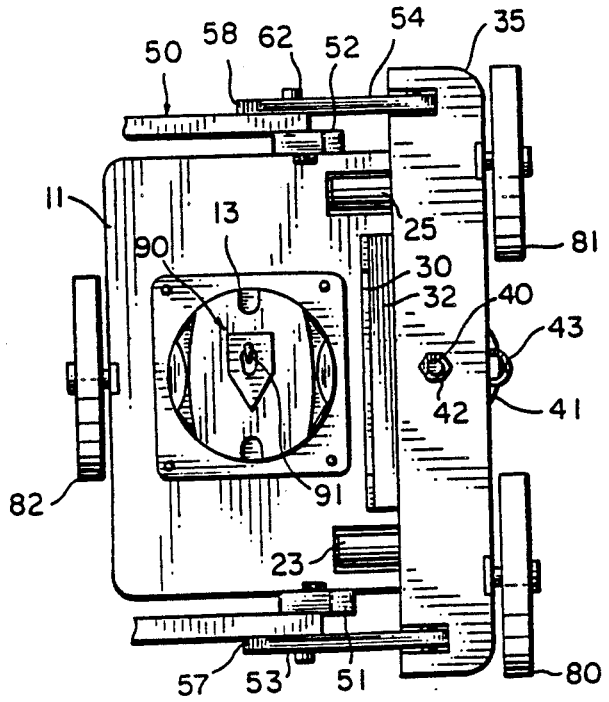
FIG. 9 is a view similar to FIG. 8, showing the pressure bar moved, to its full closed position.
Figure 10:
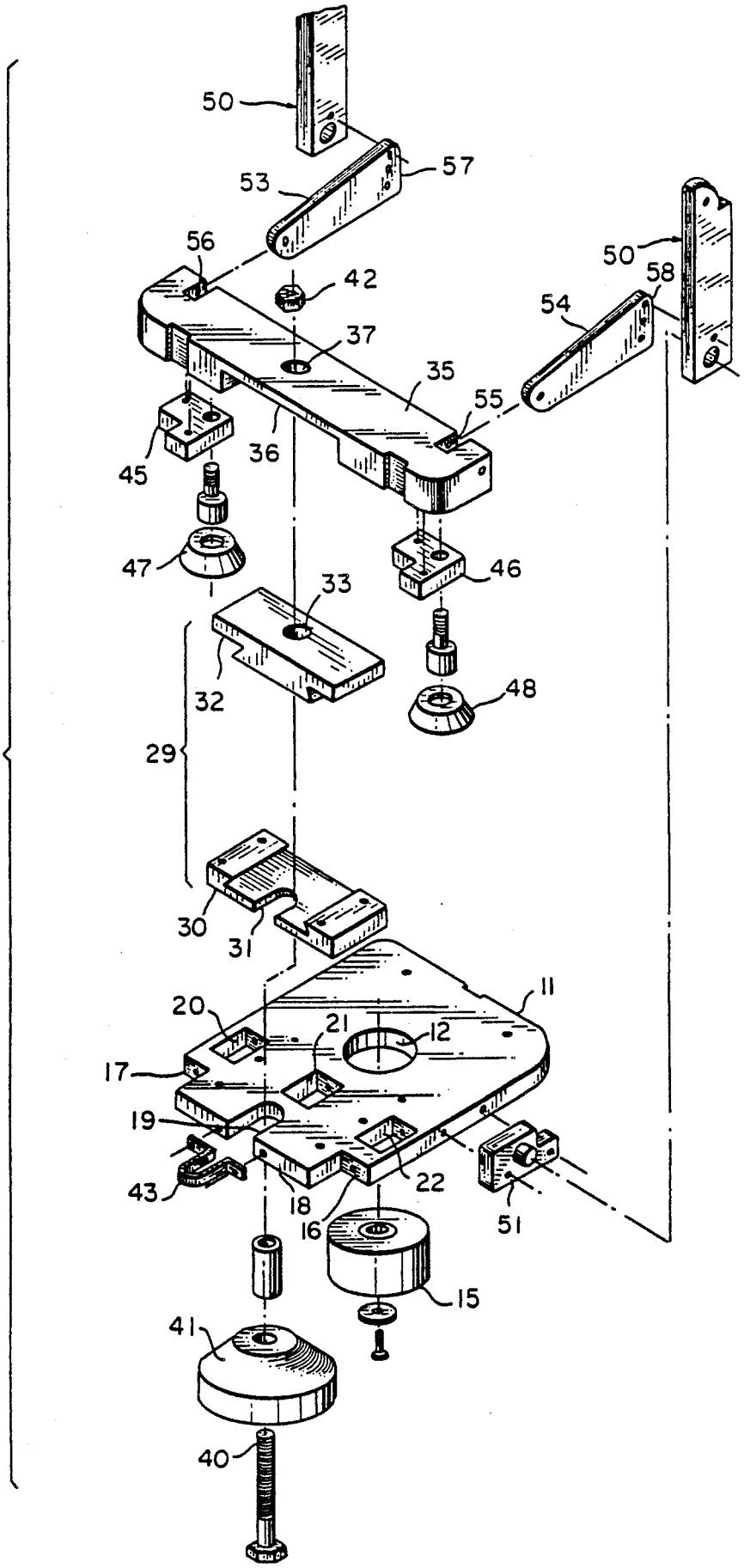
FIG. 10 is an exploded perspective view of the base plate, slide mount, pressure bar, drive wheel, forming and idler rolls, and adjustable linkage of the machine of the invention.

As seen best in FIGS. 4, 8 and 10, the base plate has notches or cut-outs 16 and 17 in the opposite corners of one side edge thereof, defining a narrowed portion 18. An elongate slot 19 is formed in the center of the narrowed portion, and a plurality of openings 20, 21 and 22 are formed through the plate in equi-spaced relationship across the width of the base plate just inwardly of the narrowed portion. Crown rolls 23, 24 and 25 are rotatably supported in the openings 20–22 for engaging the crown of a seam as it is being formed (see FIGS. 5 and 7).

A slide mount 29 has a first, female part 30 secured to the base plate at the narrowed portion, and has a slot 31 at one side edge thereof in registry with the slot 19 in the base plate. A male part 32 is mated with the female part 30 for sliding movement relative thereto and has a central opening 33 therethrough adapted to move along the length of the slots in the base plate and female part of the slide mount.

An elongate pressure distribution bar 35 has a cutout 36 in its underside, and the male part 32 of the slide mount is secured therein, whereby the pressure distribution bar is carried by the male part of the slide mount for lateral movement relative to the base plate. A central opening 37 is formed through the pressure distribution bar in registry with the opening 33 in the male part of the slide mount.

A spindle bolt 40 is extended upwardly through the slots in the base plate and female slide member, and through the aligned openings 33 and 37 in the male part and the pressure distribution bar, respectively. A main forming roll 41 is rotatable on the spindle bolt beneath the base plate 11, and a nut 42 is secured on the end of the spindle above the pressure distribution bar to hold the parts in assembled relationship. A guard or stop 43 is secured to the base plate over the end of the slot 19 to limit outward movement of the spindle bolt relative to the base plate and thus prevent disengagement of the male and female parts of the slide mount.

Bearing plates 45 and 46 are secured to the underside of the pressure distribution bar at opposite ends thereof, and idler rolls 47 and 48 are carried on the bearing plates. The idler rolls and main forming roll are symmetrically arranged on the pressure distribution bar, and are symmetrically disposed relative to the drive wheel, whereby the machine may move in either direction along a seam to form the seam. Thus, when the machine is moving in one direction, as determined by the direction of rotation of the drive wheel, one of the idler rolls will first engage the flange of the seam to preform it to a first angle (56°, for example) to smooth the transition of the material into the main forming roll which completes the seam to a second angle (56°, for example). The following idler roll serves to hold the machine square and also to apply pressure to the fulcrum represented by the drive wheel. The idler rolls also transfer a horizontal force through the crown of the seam to the drive roll on the opposite side of the seam.

Figure 18:
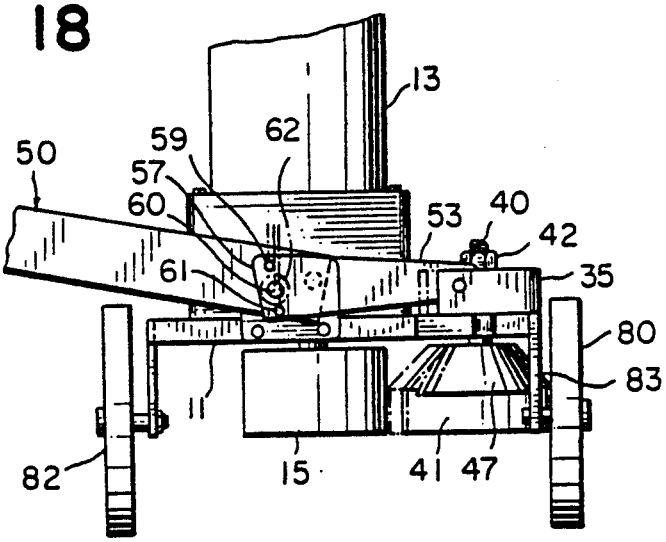
FIG. 18 is an enlarged fragmentary view in side elevation showing the relationship of the adjustable linkage, pressure bar, forming roll and drive wheel, as the linkage is adjusted to its different preset positions.

Movement of the pressure distribution bar and thus the forming and idler rolls through the range of movement of the slide mount to open the machine for application to a seam and to close the machine on the seam to form it is accomplished through an articulated handle 50 pivoted at one end on bearing blocks 51 and 52 secured to opposite sides of the base plate, and adjustable linkages 53 and 54 connected to the handle on opposite sides of the machine and to the opposite ends, respectively, of the pressure distribution bar. The adjustable linkages 53 and 54 have one of their ends pivotally attached to the pressure distribution bar in notches 55 and 56, respectively. The other ends 57 and 58 of the linkages are relatively wide and have a plurality of openings 59, 60 and 61 formed therethrough. A pivot pin 62 extends through one of the openings and into an aligned opening in the handle. As seen best in FIG. 18, each opening 59, 60 and 61 is spaced a different distance from the pivot attachment to the pressure distribution bar. Consequently, depending upon which opening the pivot pin 62 is positioned through, the rearward or closing movement of the pressure distribution bar is greater or less when the handle is moved to its full closed position. The spacing of these openings is selected to correspond to different specific gauges of metal which can be formed with the machine. Thus, the heaviest gauge metal can be accommodated when the pivot pin is inserted through the opening 59 spaced the greatest distance from the pivot attachment to the pressure distribution bar, while the lightest gauge metal can be accommodated when the pivot pin is inserted through the opening 61 spaced the closest to the pivot attachment with the pressure distribution bar. The middle opening 60, of course, accommodates an intermediate gauge metal. Accordingly, quick and easy adjustment of the machine can be accomplished for different gauges of metal. Moreover, the adjustments are preset, so that accuracy is assured. Further, as seen best in FIG. 18, the pivot attachment of the handle to the base plate is spaced relative to the pivot attachments of the opposite ends of the adjustable linkage so that an over-center motion is achieved when the handle is moved to its horizontal position to close the machine on a seam.

The handle is articulated between its ends at pivot joints 70 and 71, whereby the handle may be folded to reduce the "footprint" of the machine and thus enable it to be positioned close to an obstruction such as a parapet wall or the like. A quick-release pin 72 is inserted into an opening in the articulated handle joint to prevent the handle from folding except when desired. Suitable means, such as lanyards 73, may be employed to prevent loss of the pins 72 when they are removed from their openings in the handle.

The machine is supported for movement on caster wheels 80, 81 and 82. Two of the wheels 80 and 81 are supported from the pressure distribution bar on wheel standoff bars 83 and 84 secured in notches 85 and 86 in the outer edge of the pressure distribution bar. The third wheel 82 is similarly supported on a wheel standoff bar 87 secured in notch 88 in the opposite side of the base plate. The wheels are preferably made of an an elastomeric non-marking material to prevent marring of the panels on which the machine is used and also to provide a more secure, non-slip support for the machine.

A unique power switch 90 for energizing and deenergizing the motor is seen best in FIGS. 1 and 11–15. The switch comprises a double-pole, double-throw bat handle toggle switch 91 having a center "off" position 92 and two opposed "on" positions 93 and 94. When the machine is in one of its "on" positions, the motor is energized to drive the machine in a first direction, and when the switch is in its other "on" position, the motor is energized to drive the machine in the opposite direction.

A directional switch safety guard and annunciator 95 is secured to the motor casing over the switch 91 and comprises an arrow-shaped block 96 having one end 97 configured to indicate the direction of travel of the machine when the switch 91 is moved in that direction. The switch guard 95 is attached to the motor casing for pivotal or rotating movement about the longitudinal axis of the switch through a spacer sleeve 98 and fasteners 99 and 100 disposed coaxially with the switch. The sleeve 98 and lower end of the switch extend through a first opening 101 formed through the bottom of the guard, and the upper end of the switch extends through a second opening 102 formed through the top of the guard. A central portion of the body of the switch guard is removed at 103 for access to the fasteners 99 and 100.

Figure 13:
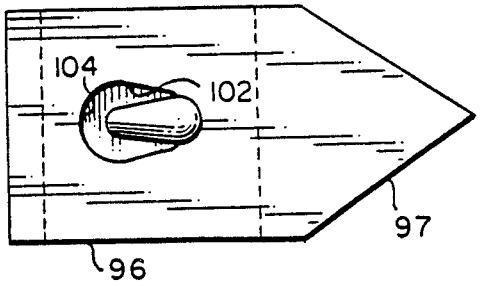
FIG. 13 is a top plan view of the switch guard of FIG. 11.
Figure 14:
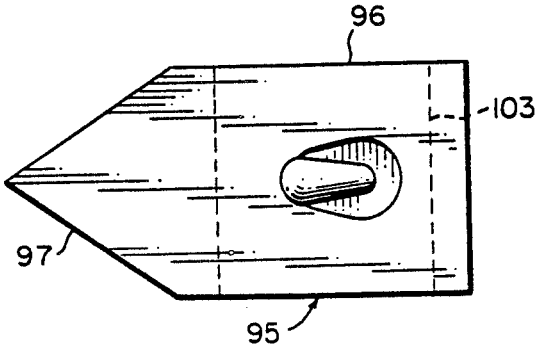
FIG. 14 is a top plan view of the switch guard of FIG. 12.
Figure 11:
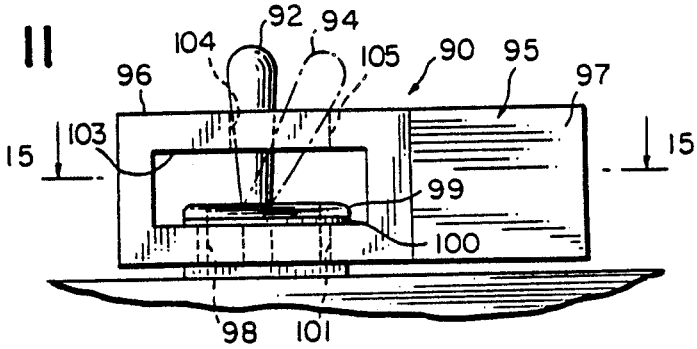
FIG. 11 is an enlarged, fragmentary view in side elevation of the switch guard and double-pole, double-throw bat handle toggle switch and switch guard of the invention, showing the switch guard in a first position for movement of the switch to one of its two "on" positions.
Figure 15:
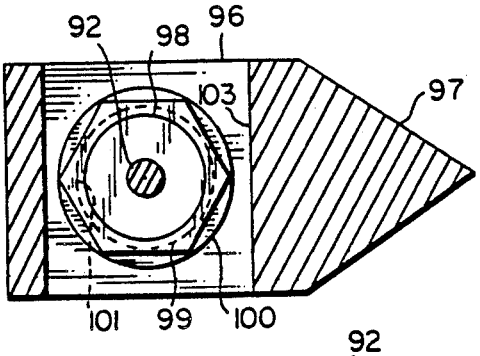
FIG. 15 is a sectional view of the switch guard, taken along line 15—15 in FIG. 11.
Figure 12:
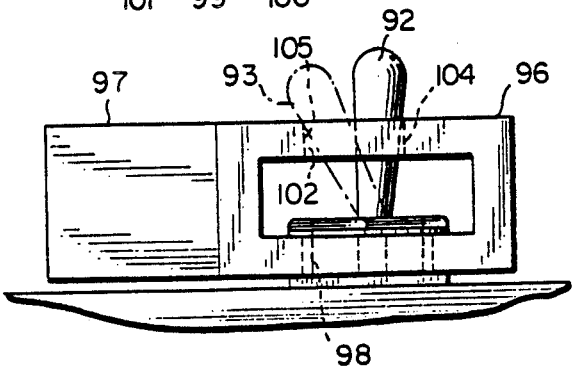
FIG. 12 is a view similar to FIG. 11, but showing the switch guard moved to its second position for movement of the switch to the other of its two "on" positions.

As seen best in FIGS. 13 and 14, the opening 102 in the top of the guard is generally tear drop shaped and has first and second ends 104 and 105 of generally circular configuration. The second end 105 is smaller in diameter than the first end, and the first and second ends are connected by straight lines or sides 106 and 107 extending tangentially to the first and second ends. Further, the generally circular first end is slightly larger in diameter than the upper end of the toggle switch and is coaxial with the first opening 101 in the bottom of the guard and with the longitudinal axis of the switch when the switch is in its upright "off" position as indicated by full lines in FIGS. 11 and 12.

Figure 16:
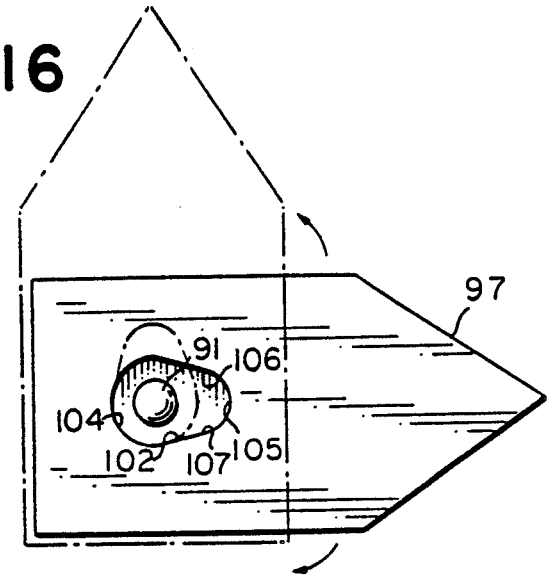
FIG. 16 is a top plan view of the switch guard of the invention, with the switch in its "off" position, and showing in dot-and-dash lines how the switch guard may be rotated about the axis of the switch without affecting the position of the switch.
Figure 17:
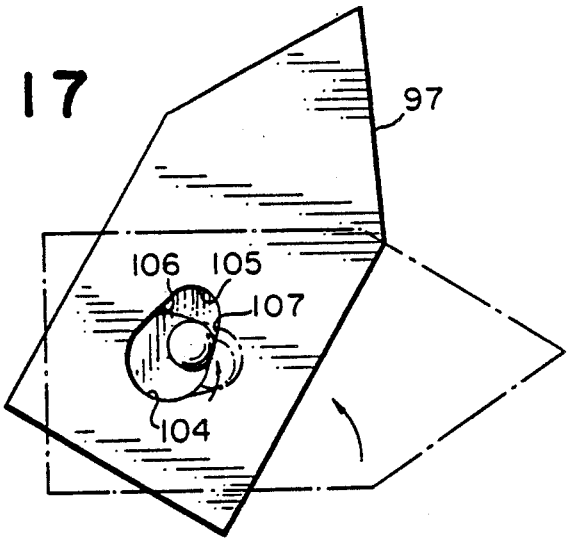
FIG. 17 is a view similar to FIG. 16, but showing how the switch guard engages the switch to move it from one of its "on" positions to its "off" position when the switch guard is, rotated to a different position while the switch is in an "on" position.

Accordingly, the guard may be rotated about the axis of the sleeve and the axis of the first end when the switch is in its "off" position without affecting the position of the switch. However, the diameter of the second end 105 is about the same as the diameter or thickness of the toggle switch where the toggle switch extends through the opening when the switch is in either of its "on" positions as indicated in dot-and-dash lines in FIGS. 11 and 12 and in full lines in FIGS. 13 and 14. Moreover, the spacing between the straight sides 106 and 107 is such that they will engage the side of the switch and move it from either of its "on" positions to its "off" position if the guard is turned while the switch is in either of its "on" positions, as shown in FIGS. 16 and 17. Thus, the operator may rotate the guard to a desired direction of operation of the machine when the end of a run is reached and the machine is turned "off". After the machine is closed on the seam as described previously, the switch may be moved to its "on" position, with the toggle disposed in the smaller end 105 of the opening 102. The arrow shape of the guard enables the operator to make a quick glance at the guard and ascertain in which direction the machine will run when energized. In the event an effort is made to rotate the guard to a different position while the machine is operating, the sides 106 and 107 will engage the toggle and move it to its "off" position, deenergizing the machine.

The base plate, bearing blocks, wheel stand-offs, handle and pressure distribution bar may all be made from aluminum (preferably 6061-T6 stock), thus making the machine very lightweight (about 30 pounds, for example). The main forming roll and the idler rolls are preferably constructed of steel, as in conventional machines. The adjustments in the linkage are designed to accommodate either 26, 24 or 22 gauge material, and the gear motor and drive wheel are designed to achieve a seaming speed of about 20–30 ft/min. for efficient roof crew operation with safety limitations considered. The articulated handle permits a side clearance of about 5¾ inches.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. In a roof seaming machine for forming a seam between adjacent edges of roof panels, wherein said machine has at least one forming roll and an opposed drive wheel, driven by a reversible electric motor, for propelling the machine in either a forward or a reverse direction along the seam and for forming a seam between the forming roll and drive wheel, the improvement comprising:

a directional switch mounted on the machine, in an electric circuit with the reversible electric motor, said switch having a center "off" position and two opposed "on" positions; and a multi-position directional switch safety guard mounted over the switch, the guard being movable between first and second positions, and comprising means for enabling the switch to be moved between its "off" position and only one of its "on" positions only when the guard is in said first position and for enabling the switch to be moved between its "off" position and only the other of its "on" positions only when the guard is in said second position.

2. A roof seaming machine as claimed in claim 1, wherein:

the switch guard has means for indicating to the operator which direction the machine will move when the switch is moved to its "on" position as permitted by the guard.

3. A roof seaming machine as claimed in claim 2, wherein:

the switch guard includes means for automatically moving the switch from an "on" opposition to its "off" position when the guard is moved between said first and second positions.

4. A roof seaming machine as claimed in claim 3, wherein:

the switch is a double-pole, double-throw switch comprising a housing and a handle protruding therefrom, said handle extending along a first axis when the switch is in its "off" position; and the switch guard is mounted for rotation about said first axis and has an elongated opening therein through which said handle extends, said opening having lateral sides, and the means for automatically moving the switch is the lateral sides of the opening.

5. A guarded switch construction for a machine having a reversible electric motor, comprising a directional switch mounted on the machine, in an electric circuit with the reversible electric motor, said switch having a center "off" position and two opposed "on" positions; and a multi-position directional switch safety guard mounted over the switch, the guard being movable between first and second positions, and comprising means for enabling the switch to be moved between its "off" position and only one of its "on" positions only when the guard is in said first position and for enabling the switch to be moved between its "off" position and the other of its "on" positions only when the guard is in said second position.

* * * * *